US011402134B2

(12) United States Patent
Choi et al.

(10) Patent No.: US 11,402,134 B2
(45) Date of Patent: Aug. 2, 2022

(54) OUTDOOR UNIT AND CONTROL METHOD THEREOF

(71) Applicant: LG ELECTRONICS INC., Seoul (KR)

(72) Inventors: Jaeheuk Choi, Seoul (KR); Byoungjin Ryu, Seoul (KR); Yoonho Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 149 days.

(21) Appl. No.: 16/608,957

(22) PCT Filed: Apr. 27, 2018

(86) PCT No.: PCT/KR2018/004910
§ 371 (c)(1),
(2) Date: Oct. 28, 2019

(87) PCT Pub. No.: WO2018/199682
PCT Pub. Date: Nov. 1, 2018

(65) Prior Publication Data

US 2020/0191459 A1 Jun. 18, 2020

(30) Foreign Application Priority Data

Apr. 28, 2017 (KR) ..... 10-2017-0055474

(51) Int. Cl.
*F25B 7/00* (2006.01)
*F25B 41/20* (2021.01)
(Continued)

(52) U.S. Cl.
CPC ..... *F25B 7/00* (2013.01); *F25B 40/02* (2013.01); *F25B 41/20* (2021.01); *F25B 49/02* (2013.01);
(Continued)

(58) Field of Classification Search
CPC ..... F25B 49/02; F25B 41/20; F25B 7/00; F25B 40/02; F25B 2400/0417; F25B 2600/2501;
(Continued)

(56) References Cited

U.S. PATENT DOCUMENTS 5,092,134 A 3/1992 Tagashira et al.
6,474,087 B1 * 11/2002 Lifson ..... F04C 29/0014 62/199
2010/0199712 A1 * 8/2010 Lifson ..... F25B 41/20 62/498
2013/0180276 A1 7/2013 Choi et al.
2015/0267954 A1 9/2015 Ryu et al.

FOREIGN PATENT DOCUMENTS

EP 0972942 1/2000
EP 2615392 7/2013
(Continued)

OTHER PUBLICATIONS

Kawano et al., Heat Pump, Jan. 30, 2014, JP2014016079A, Whole Document (Year: 2014).*
(Continued)

*Primary Examiner* — Larry L Furdge
(74) *Attorney, Agent, or Firm* — KED & Associates, LLP

(57) ABSTRACT

An outdoor unit is connected to a refrigerator and has two compressors that are connected in series, and a control method thereof. The outdoor unit according to an embodiment of the present invention includes a low pressure side compressor for compressing a refrigerant; a high pressure side compressor for compressing the refrigerant compressed by the low pressure side compressor; an outdoor heat exchanger for condensing the refrigerant compressed by the high pressure side compressor; a heat recovery unit for cooling the refrigerant condensed in the outdoor heat exchanger by exchanging heat with the refrigerant evapo-
(Continued)

rated in the air conditioner; and a supercooler for expanding a part of the refrigerant cooled in the heat recovery unit to cool another part of the refrigerant cooled in the heat recovery unit, so that the discharge temperature of the low pressure side compressor and/or the high pressure side compressor can be reduced.

3 Claims, 7 Drawing Sheets

(51) Int. Cl.
*F25B 40/02* (2006.01)
*F25B 49/02* (2006.01)

(52) U.S. Cl.
CPC ..... *F25B 2400/0417* (2013.01); *F25B 2600/2501* (2013.01); *F25B 2700/21152* (2013.01)

(58) Field of Classification Search
CPC .... F25B 2700/21152; F25B 6/04; F25B 1/10; F25B 40/00; F25B 41/40; F25B 2600/2509; F25B 2400/13; F25B 2400/0403; F25B 2400/0409; F25B 2400/0411; F25B 2400/19; F25B 2313/0252; F25B 41/26; A47F 3/04; A47F 3/0478
See application file for complete search history.

(56) References Cited

FOREIGN PATENT DOCUMENTS

| | | | | |
|---|---|---|---|---|
| EP | 2631563 | | | 8/2013 |
| JP | 2008-249219 | | | 10/2008 |
| JP | 4771721 | | | 9/2011 |
| JP | 2014-016079 | | | 1/2014 |
| JP | 2014016079 | A | * | 1/2014 |
| KR | 10-1991-0021567 | | | 12/1991 |
| KR | 10-2013-0081794 | | | 7/2013 |
| KR | 10-1303483 | | | 9/2013 |
| KR | 10-1402158 | | | 6/2014 |
| KR | 10-2015-0048350 | | | 5/2015 |
| KR | 10-2015-0109746 | | | 10/2015 |

OTHER PUBLICATIONS

European Search Report dated Nov. 5, 2020 issued in Application No. 18792077.2.
Korean Notice of Allowance dated Sep. 27, 2018 issued in Application No. 10-2017-0055474.
International Search Report (with English Translation) dated Sep. 7, 2018 issued in Application No. PCT/KR2018/004910.
Written Opinion dated Sep. 7, 2018 issued in Application No. PCT/KR2018/004910.

* cited by examiner

OUTDOOR UNIT AND CONTROL METHOD THEREOF

CROSS-REFERENCE TO RELATED PATENT APPLICATIONS

This application is a U.S. National Stage Application under 35 U.S.C. § 371 of PCT Application No. PCT/KR2018/004910, filed Apr. 27, 2018, which claims priority to Korean Patent Application No. 10-2017-0055474, filed Apr. 28, 2017, whose entire disclosures are hereby incorporated by reference.

TECHNICAL FIELD

The present invention relates to an outdoor unit and a control method thereof, and more particularly, to an outdoor unit which is connected to a refrigerator and has two compressors that are connected in series, and a control method thereof.

BACKGROUND ART

A refrigeration system is an apparatus that maintains the internal temperature of a refrigerator at a low temperature by using a cooling cycle consisting of a compressor, a condenser, an expander, and an evaporator.

The refrigeration system includes a refrigerator for storing and displaying a storage such as food, and an outdoor unit which is installed outdoors and connected to the refrigerator through a refrigerant pipe. The outdoor unit is provided with a compressor and a condenser, and the refrigerator is provided with an expansion valve and an evaporator. The refrigeration system may be configured by connecting a single refrigerator and a single outdoor unit, or by a combination of a plurality of refrigerators and/or a plurality of outdoor units.

In order to maintain the refrigerating performance of the refrigerator, such a refrigeration system should not allow the discharge temperature, which is the temperature of the refrigerant discharged from the compressor, to be excessively high. In particular, when the outdoor unit is difficult to directly control the refrigerator, it is not possible to control the expansion valve of the refrigerator. Therefore, it is important to manage the discharge temperature. In order to reduce the discharge temperature, the outdoor unit is provided with a supercooler for supercooling the refrigerant condensed in the condenser. However, in the case of increasing the supercooling performance of the supercooler under a high outdoor temperature, the amount of refrigerant, which is expanded in the supercooler, that is bypassed to the compressor becomes larger. Therefore, there is a problem that the refrigerating performance of the refrigerator is lowered and the efficiency of the entire system is lowered.

DISCLOSURE

Technical Problem

An object of the present invention is to provide an outdoor unit capable of reducing the discharge temperature while reducing the bypass amount of the refrigerant through the supercooler, and a control method thereof.

The objects of the present invention are not limited to the above-mentioned objects, and other objects that are not mentioned will be clearly understood by those skilled in the art from the following description.

Technical Solution

In order to achieve the above objects, an outdoor unit according to an embodiment of the present invention includes a low pressure side compressor for compressing a refrigerant; a high pressure side compressor for compressing the refrigerant compressed by the low pressure side compressor; an outdoor heat exchanger for condensing the refrigerant compressed by the high pressure side compressor; a heat recovery unit for cooling the refrigerant condensed in the outdoor heat exchanger by exchanging heat with the refrigerant evaporated in the air conditioner; and a supercooler for expanding a part of the refrigerant cooled in the heat recovery unit to cool another part of the refrigerant cooled in the heat recovery unit, so that the discharge temperature of the low pressure side compressor and/or the high pressure side compressor can be reduced.

The supercooler includes a supercooling expansion valve for expanding a part of the refrigerant cooled in the heat recovery unit; a supercooling heat exchanger for cooling another part of the refrigerant cooled in the heat recovery unit by exchanging heat with the refrigerant expanded in the supercooling expansion valve; a bypass valve for guiding the refrigerant which is expanded in the supercooling expansion valve and evaporated in the supercooling heat exchanger to a suction side of the low pressure side compressor when opened; and an injection valve for guiding the refrigerant which is expanded in the supercooling expansion valve and evaporated in the supercooling heat exchanger to a suction side of the high-pressure side compressor when opened.

The outdoor unit further includes a low pressure side discharge temperature sensor for measuring a low pressure side discharge temperature which is a temperature of the refrigerant discharged from the low pressure side compressor; and a high pressure side discharge temperature sensor for measuring a high pressure side discharge temperature which is a temperature of the refrigerant discharged from the high pressure side compressor, wherein the bypass valve is opened according to the low pressure side discharge temperature measured by the low pressure side discharge temperature sensor, and the injection valve is opened according to the high pressure side discharge temperature measured by the high pressure side discharge temperature sensor.

The injection expansion valve is opened and closed according to the low pressure side discharge temperature measured by the low pressure side discharge temperature sensor and the high pressure side discharge temperature measured by the high pressure side discharge temperature sensor.

The injection expansion valve has a higher opening degree when both the bypass valve and the injection valve are opened than when only the bypass valve or the injection valve is opened.

In order to achieve the above objects, a method of controlling an outdoor unit includes a discharge temperature measuring step of measuring a low pressure side discharge temperature which is a temperature of a refrigerant discharged from the low pressure side compressor, and a high pressure side discharge temperature which is a temperature of a refrigerant discharged from the high pressure side compressor; and a supercooling step of guiding the refrigerant expanded in the supercooler to a suction side of the low pressure side compressor or a suction side of the high pressure side compressor according to the low pressure side discharge temperature or the high pressure side discharge temperature, so that the discharge temperature of the low pressure side compressor and/or the high pressure side compressor can be reduced.

The supercooling step includes: opening the supercooling expansion valve according to the low pressure side discharge temperature and the high pressure side discharge temperature; opening the bypass valve according to the low pressure side discharge temperature; and opening the injection valve according to the high pressure side discharge temperature.

Advantageous Effects

The outdoor unit and the control method thereof according to the present invention have one or more of the following effects.

First, there is an advantage in that the discharge temperature of the low pressure side compressor and/or the high pressure side compressor can be reduced without reducing the amount of refrigerant flowing into the refrigerator.

Second, there is an advantage in that when the discharge temperature of only one of the high pressure side compressor and the low pressure side compressor is high, it is possible to reduce the discharge temperature while ensuring the maximum amount of refrigerant flowing into the refrigerator by introducing the refrigerant expanded and evaporated in the supercooler only to a corresponding compressor.

Third, there is also an advantage of improving the cycle efficiency and increasing the refrigerating performance of the refrigerator by ensuring the amount of the refrigerant flowing into the refrigerator even under high outdoor temperature conditions.

The effects of the present invention are not limited to the effects mentioned above, and other effects not mentioned can be clearly understood by those skilled in the art from the description of the claims.

MODE FOR INVENTION

Figure 1:
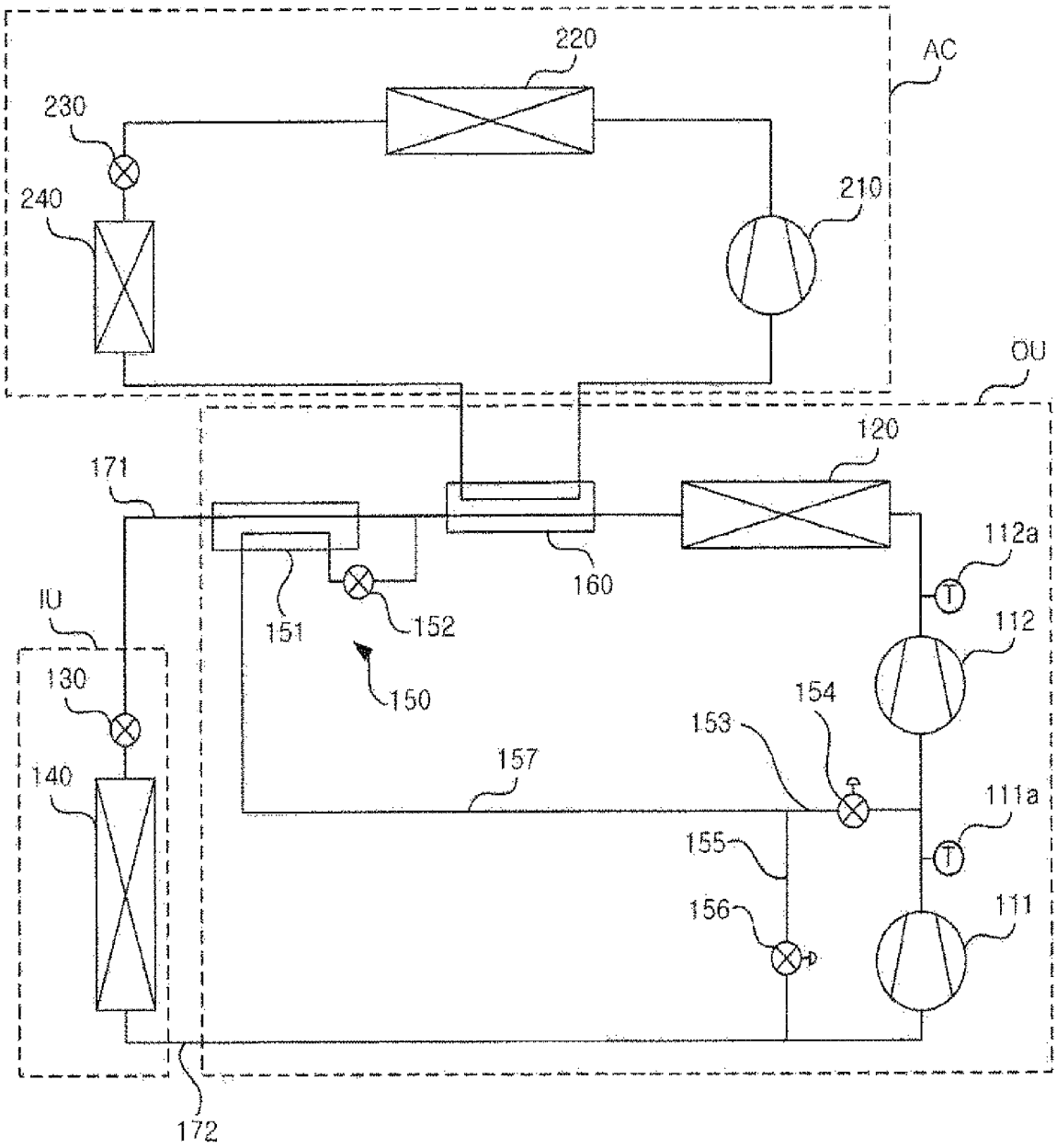
FIG. 1 is a block diagram of a refrigeration system according to an embodiment of the present invention.

Prior to a detailed description of the present invention, terms and words used in the specification and the claims shall not be interpreted as commonly-used dictionary meanings, but shall be interpreted as to be relevant to the technical scope of the invention based on the fact that the inventor may property define the concept of the terms to explain the invention in best ways. Therefore, the embodiments and the configurations depicted in the drawings are illustrative purposes only and do not represent all technical scopes of the embodiments, so it should be understood that various equivalents and modifications may exist at the time of filing this application. In describing the present embodiment, the same designations and the same reference numerals are used for the same components, and further description thereof will be omitted.

Hereinafter, the present invention will be described with reference to the drawings for illustrating an outdoor unit and a control method thereof according to embodiments of the present invention.

Figure 2:
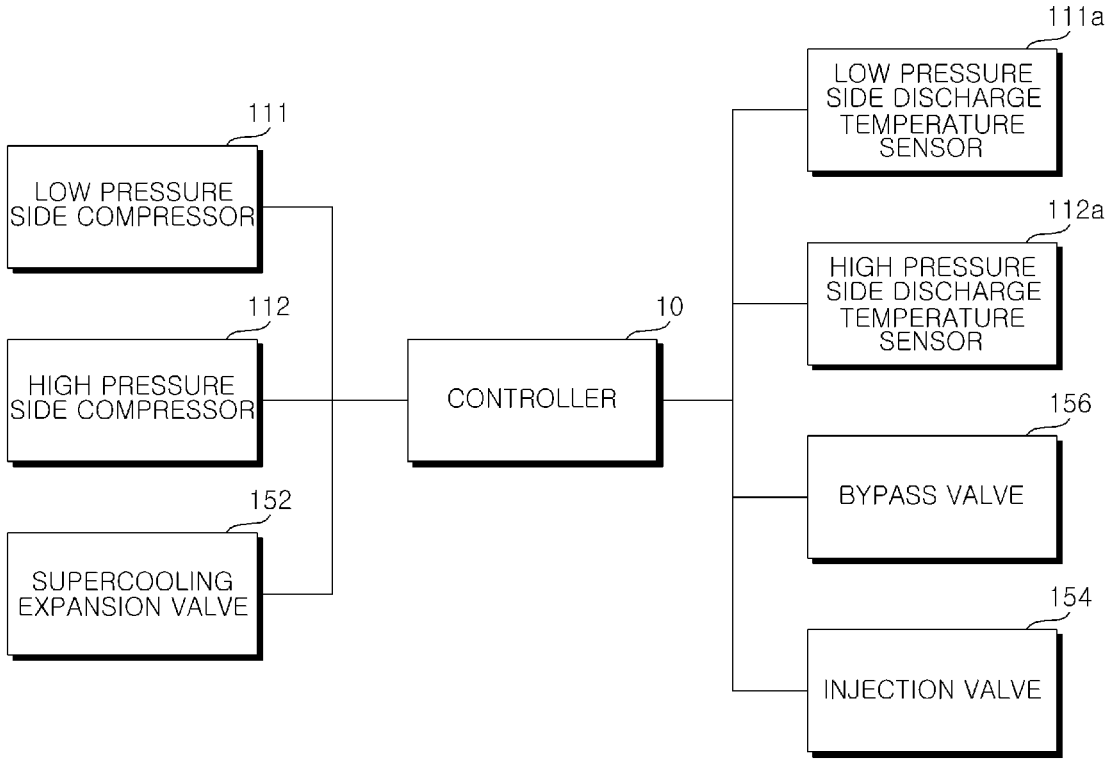
FIG. 2 is a block diagram of an outdoor unit according to an embodiment of the present invention.

FIG. 1 is a block diagram of a refrigeration system according to an embodiment of the present invention. FIG. 2 is a block diagram of an outdoor unit according to an embodiment of the present invention.

A refrigeration system according to an embodiment of the present invention includes a refrigerator (IU) for refrigerating or cooling the storage, an air conditioner AC for cooling the room, an outdoor unit (OU) for compressing and condensing refrigerant to supply to the refrigerator (IU), and a liquid pipe 171 and an gas pipe 172 connecting the outdoor unit (OU) and the refrigerator (IU).

Refrigerator (IU) is installed indoors, such as a mart, a convenience store, supermarket, or the like, to display and store the storage, such as food. The refrigerator (IU) expands and evaporates the refrigerant to refrigerate or freeze the storage. Refrigerator (IU) is provided with a plurality may be connected in parallel to the outdoor unit (OU). The inlet side of the refrigerator (IU) is connected to the liquid pipe 171, and the outlet side of the refrigerator (IU) is connected to the gas pipe 172.

The refrigerator (IU) includes a refrigeration expansion valve 130 for expanding the refrigerant and a refrigeration heat exchanger 140 for evaporating the refrigerant expanded in the refrigeration expansion valve 130.

The opening degree of the refrigeration expansion valve 130 is adjusted to expand the refrigerant condensed in the outdoor unit (OU). The inlet side of the refrigeration expansion valve 130 is connected to the liquid pipe 171 and the outlet side is connected to the refrigeration heat exchanger 140. The refrigerant expanded in the refrigeration expansion valve 130 flows to the refrigeration heat exchanger 140.

The refrigeration heat exchanger 140 evaporates the refrigerant expanded in the refrigeration expansion valve 130 to cool the air. The inlet side of the refrigeration heat exchanger 140 is connected to the refrigeration expansion valve 130 and the outlet side is connected to the gas pipe 172. The refrigerant evaporated in the refrigeration heat exchanger 140 flows to the outdoor unit (OU) through the gas pipe 172.

The air conditioner AC cools indoor air to cool the room. The air conditioner AC includes an air conditioning compressor 210 for compressing the refrigerant, an air conditioning condenser 220 for condensing the refrigerant compressed in the air conditioning compressor 210 by heat exchange with the outdoor air, an air conditioning expansion valve 230 for expanding the refrigerant condensed in the air conditioning condenser 220, and an air conditioning evaporator 240 for evaporating the refrigerant expanded in the air conditioning expansion valve 230 by heat exchange with the indoor air. The air conditioning compressor 210 and the air conditioning condenser 220 are installed outdoor, the air conditioning expansion valve 230 and the air conditioning evaporator 240 are installed indoor. The air conditioning evaporator 240 cools the room by evaporating the refrigerant. The refrigerant evaporated from the air conditioning evaporator 240 passes through a heat recovery unit 160 of the outdoor unit (OU) described later, and then flows to the air conditioning compressor 210.

The outdoor unit (OU) is installed outdoor to compress and condense the refrigerant. A plurality of outdoor units (OUs) may be provided to be connected to the refrigerator (IU) in parallel. The inlet side of the outdoor unit (OU) is connected to the gas pipe 172 and the outlet side is connected to the liquid pipe 171.

The outdoor unit (OU) includes a low pressure side compressor 111 for compressing a refrigerant, a high pressure side compressor 112 for compressing the refrigerant compressed by the low pressure side compressor 111, an outdoor heat exchanger 120 for condensing the refrigerant compressed by the high pressure side compressor 112, a heat recovery unit 160 for cooling the refrigerant condensed in the outdoor heat exchanger 120 by heat exchange with the refrigerant evaporated in the air conditioner AC, and a supercooler 150 for supercooling the refrigerant heat exchanged in the heat recovery unit 160.

The low pressure side compressor 111 compresses a low temperature low pressure refrigerant into a high temperature high pressure refrigerant. Various structures may be applied to the low pressure side compressor 111, and may be a reciprocating compressor using a cylinder and a piston or may be a scroll compressor using an orbiting scroll and a fixed scroll.

The low pressure side compressor 111 compresses the refrigerant evaporated in the refrigerator (IU) and flowed into the gas pipe 172 and/or the refrigerant flowed into a bypass pipe 155 of the supercooler 150. The suction side of the low pressure side compressor 111 is connected to the gas pipe 172 and the bypass pipe 155, and the discharge side of the low pressure side compressor 111 is connected to an injection pipe 153 and the high pressure side compressor 112. The refrigerant compressed in the low pressure side compressor 111 flows to the high pressure side compressor 112.

The high pressure side compressor 112 compresses the low temperature low pressure refrigerant into the high temperature high pressure refrigerant. Various structures may be applied to the high pressure side compressor 112, and may be a reciprocating compressor using a cylinder and a piston or a scroll compressor using an orbiting scroll and a fixed scroll.

The high pressure side compressor 112 compresses the refrigerant compressed in the low pressure side compressor 111 and/or the refrigerant flowed into the injection pipe 153 of the supercooler 150. The suction side of the high pressure side compressor 112 is connected to the injection pipe 153 and the low pressure side compressor 111, and the discharge side of the high pressure side compressor 112 is connected to the outdoor heat exchanger 120. The refrigerant compressed in the low pressure side compressor 111 flows to the outdoor heat exchanger 120.

The outdoor heat exchanger 120 condenses the refrigerant compressed in the high pressure side compressor 112. The outdoor heat exchanger 120 heat exchanges the outdoor air flowing to the outdoor heat exchanger 120 by a blower fan (not shown) with the refrigerant compressed in the high pressure side compressor 112. The inlet side of the outdoor heat exchanger 120 is connected to the high pressure side compressor 112, and the outlet side of the outdoor heat exchanger 120 is connected to the heat recovery unit 160.

The heat recovery unit 160 heat-exchanges and cools the refrigerant condensed in the outdoor heat exchanger 120 with the refrigerant evaporated in the air conditioner AC. The heat recovery unit 160 is a tubular heat exchanger which heat exchanges the refrigerant flowing from the outdoor heat exchanger 120 to the supercooler with the refrigerant flowing from the air conditioner evaporator 240 of the air conditioner AC to the air conditioner compressor 210 of the air conditioner AC. The heat recovery unit 160 cools the refrigerant condensed in the outdoor heat exchanger 120 by the low temperature low pressure refrigerant evaporated in the air conditioner AC. A first inlet side of the heat recovery unit 160 is connected to the outdoor heat exchanger 120, a second inlet side is connected to the air conditioning evaporator 240 of the air conditioner AC, a first outlet side of the heat recovery unit 160 is connected to the supercooler 150, and a second outlet side is connected to the air conditioning compressor 210 of the air conditioner AC. The refrigerant cooled in the heat recovery unit 160 flows to the supercooler 150.

The supercooler 150 cools the refrigerant condensed in the outdoor heat exchanger 120. The supercooler 150 expands a part of the refrigerant which is condensed in the outdoor heat exchanger 120 and then is cooled in the heat recovery unit 160, thereby cooling another part of the refrigerant which is condensed in the outdoor heat exchanger 120 and then is cooled in the heat recovery unit 160. The inlet side of the supercooler 150 is connected to the heat recovery, and the first outlet side of the supercooler 150 is connected to the liquid pipe 171. The second outlet side of the supercooler 150 is connected to the low pressure side compressor 111 and the high pressure side compressor 112. The refrigerant cooled in the supercooler 150 flows to the refrigerator (IU) through the liquid pipe 171, and the refrigerant expanded and evaporated in the supercooler 150 is flows to the low pressure side compressor 111 or the high pressure side compressor 112. The supercooler 150 may operate or may not operate according to the low pressure side discharge temperature measured by a low pressure side discharge temperature sensor 111*a* and/or the high pressure side discharge temperature measured by a high pressure side discharge temperature sensor 112*a*.

The supercooler 150 includes a supercooling expansion valve 152 for expanding a part of the refrigerant cooled in the heat recovery unit 160, a supercooling heat exchanger 151 for cooling another part of the refrigerant cooled in the heat recovery unit 160 by exchanging heat with the refrigerant expanded in the supercooling expansion valve 152, a bypass valve 156 for guiding the refrigerant which is expanded in the supercooling expansion valve 152 and is evaporated in the supercooling heat exchanger 151 to the suction side of the low pressure side compressor 111 when opened, and an injection valve 154 for guiding the refrigerant which is expanded in the supercooling expansion valve 152 and is evaporated in the supercooling heat exchanger 151 to the suction side of the high pressure side compressor 112 when opened.

The supercooling expansion valve 152 is opened by a controller 10 to adjust the opening degree or is closed. The supercooling expansion valve 152 expands a part of the refrigerant cooled in the heat recovery unit 160 when opened. The inlet side of the supercooling expansion valve 152 is connected to the heat recovery unit 160, and the outlet side is connected to the supercooling heat exchanger 151. The supercooling expansion valve 152 may be opened or closed according to the low pressure side discharge temperature measured by the low pressure side discharge temperature sensor 111*a* and/or the high pressure side discharge temperature measured by the high pressure side discharge temperature sensor 112*a*.

The supercooling heat exchanger 151 exchanges heat between the refrigerant expanded in the supercooling expansion valve 152 and another part of the refrigerant cooled in the heat recovery unit 160. The supercooling heat exchanger 151 evaporates the refrigerant expanded in the supercooling expansion valve 152 and cools another part of the refrigerant cooled in the heat recovery unit 160.

The first inlet side of the supercooling heat exchanger 151 is connected to the heat recovery unit 160 and the first outlet side is connected to the liquid pipe 171. The second inlet side of the supercooling heat exchanger 151 is connected to the supercooling expansion valve 152 and the second outlet side is connected to a supercooling pipe 157.

In the supercooling pipe 157, the refrigerant which is expanded in the supercooling expansion valve 152 and then is evaporated in the supercooling heat exchanger 151 flows. The inlet side of the supercooling pipe 157 is connected to the supercooling heat exchanger 151 and the outlet side is branched into the bypass pipe 155 and the injection pipe 153.

The bypass pipe 155 connects the supercooling pipe 157 and the suction side of the low pressure side compressor 111. The bypass valve 156 is disposed in the bypass pipe 155.

The bypass valve 156 is disposed in the bypass pipe 155 to control the flow of the refrigerant flowing through the bypass pipe 155. The bypass valve 156 guides the refrigerant evaporated in the supercooling heat exchanger 151 after being expanded in the supercooling expansion valve 152 to the low pressure side compressor 111 through the bypass pipe 155 when opened. The bypass valve 156 is opened and closed according to the low pressure side discharge temperature measured by the low pressure side discharge temperature sensor 111*a*.

The injection pipe 153 connects the supercooling pipe 157 and the suction side (the discharge side of the low pressure side compressor 111) of the high pressure side compressor 112. The injection valve 154 is disposed in the injection pipe 153.

The injection valve 154 is disposed in the injection pipe 153 to control the flow of the refrigerant flowing through the injection pipe 153. The injection valve 154 guides the refrigerant evaporated in the supercooling heat exchanger 151 after being expanded in the supercooling expansion valve 152 to the high pressure side compressor 112 through the injection pipe 153. The injection valve 154 is opened and closed according to the high pressure side discharge temperature measured by the high pressure side discharge temperature sensor 112*a*.

The low pressure side discharge temperature sensor 111*a* measures the low pressure side discharge temperature, which is the temperature of the refrigerant discharged from the low pressure side compressor 111. The low pressure side discharge temperature sensor 111*a* is disposed in the outlet side of the low pressure side compressor 111. The low pressure side discharge temperature sensor 111*a* transmits the measured low pressure side discharge temperature to the controller 10.

The high pressure side discharge temperature sensor 112*a* measures the high pressure side discharge temperature which is a temperature of the refrigerant discharged from the high pressure side compressor 112. The high pressure side discharge temperature sensor 112*a* is disposed in the outlet side of the high pressure side compressor 112. The high pressure side discharge temperature sensor 112*a* transmits the measured high pressure side discharge temperature to the controller 10.

The controller 10 controls the operation of the outdoor unit (OU). The controller 10 controls the operation speed of the high pressure side compressor 112 and the low pressure side compressor 111 according to the user's setting, the pressure and/or temperature of the refrigerant. The controller 10 controls the supercooling expansion valve 152, the bypass valve 156, and the injection valve 154 according to the low pressure side discharge temperature measured by the low pressure side discharge temperature sensor 111*a* and/or the high pressure side discharge temperature measured by the high pressure side discharge temperature sensor 112*a*.

Figure 3:
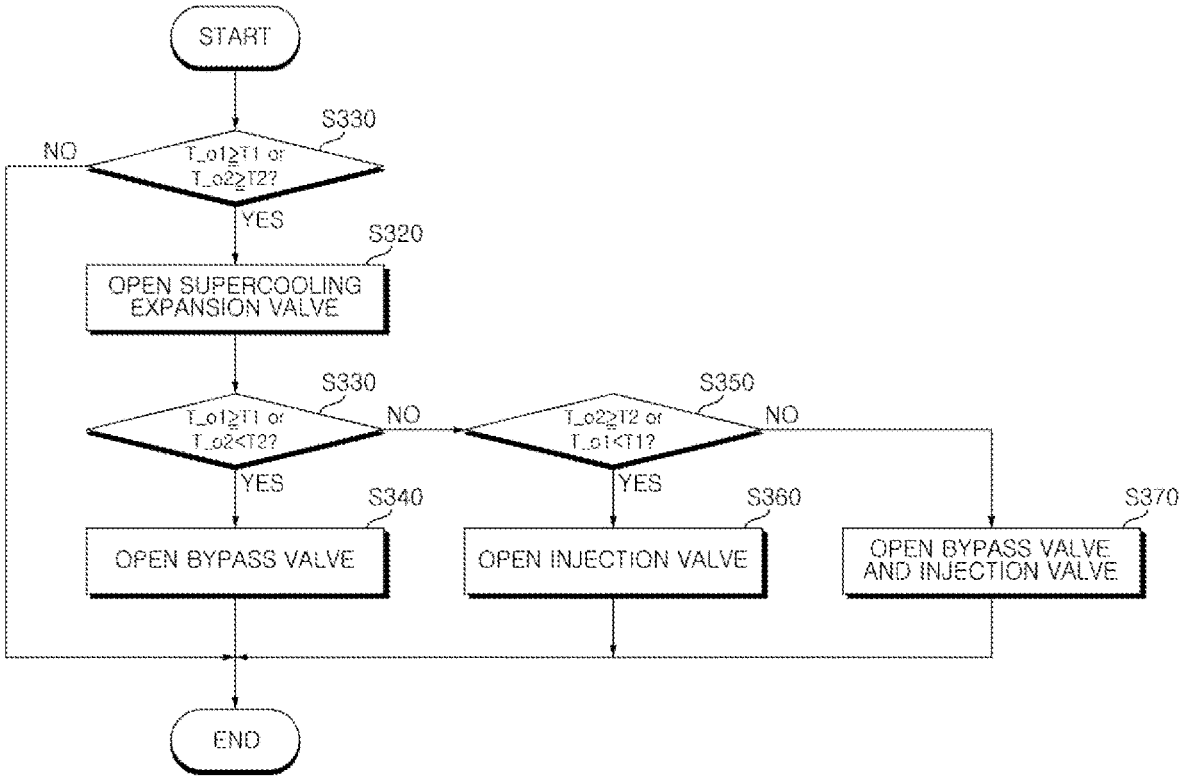
FIG. 3 is a flowchart illustrating a control method of an outdoor unit according to an embodiment of the present invention.
Figure 4:
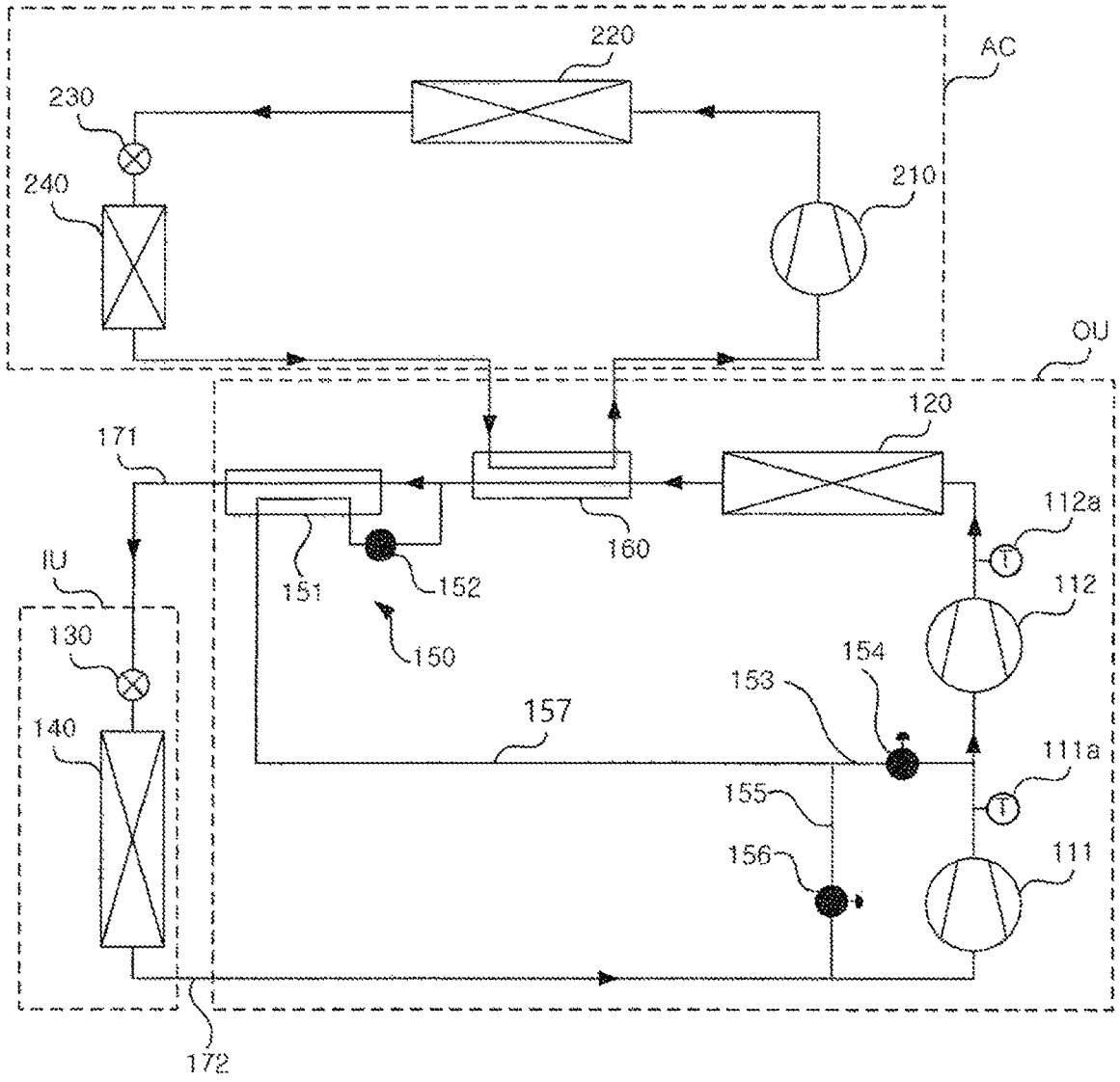
FIG. 4 is a view showing flow of refrigerant in non-operation of a supercooler in an outdoor unit according to an embodiment of the present invention.
Figure 5:
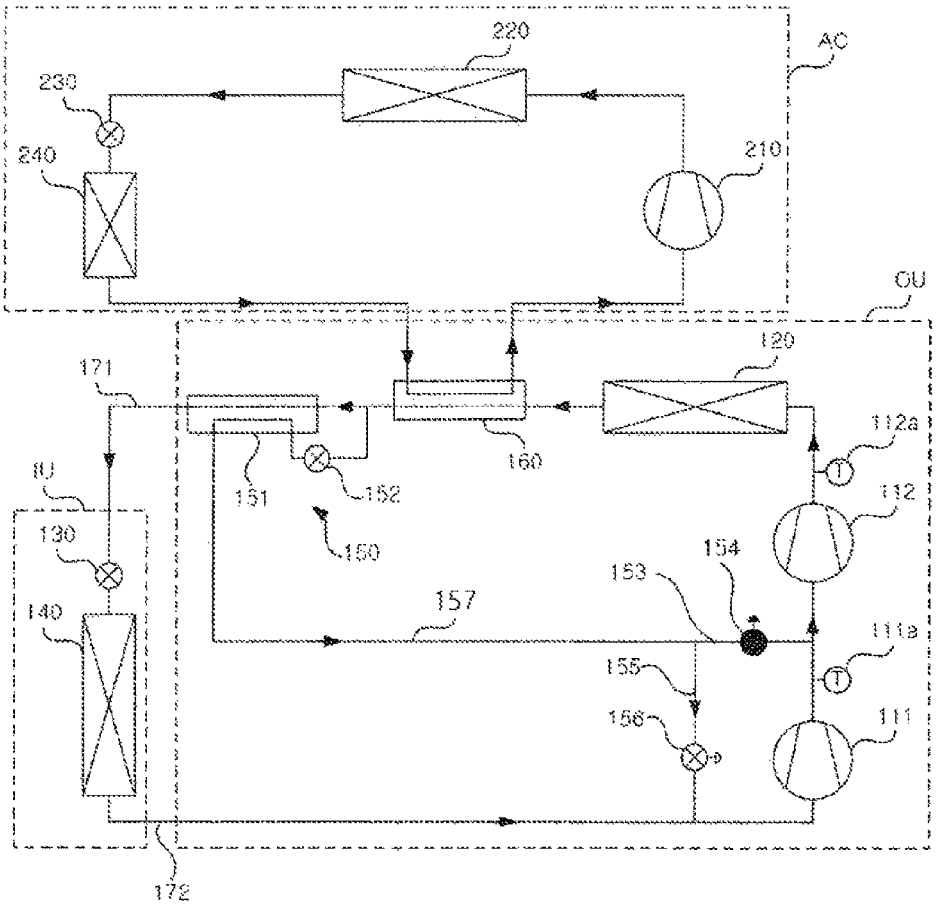
FIG. 5 is a view showing flow of refrigerant when opening a bypass valve in an outdoor unit according to an embodiment.
Figure 6:
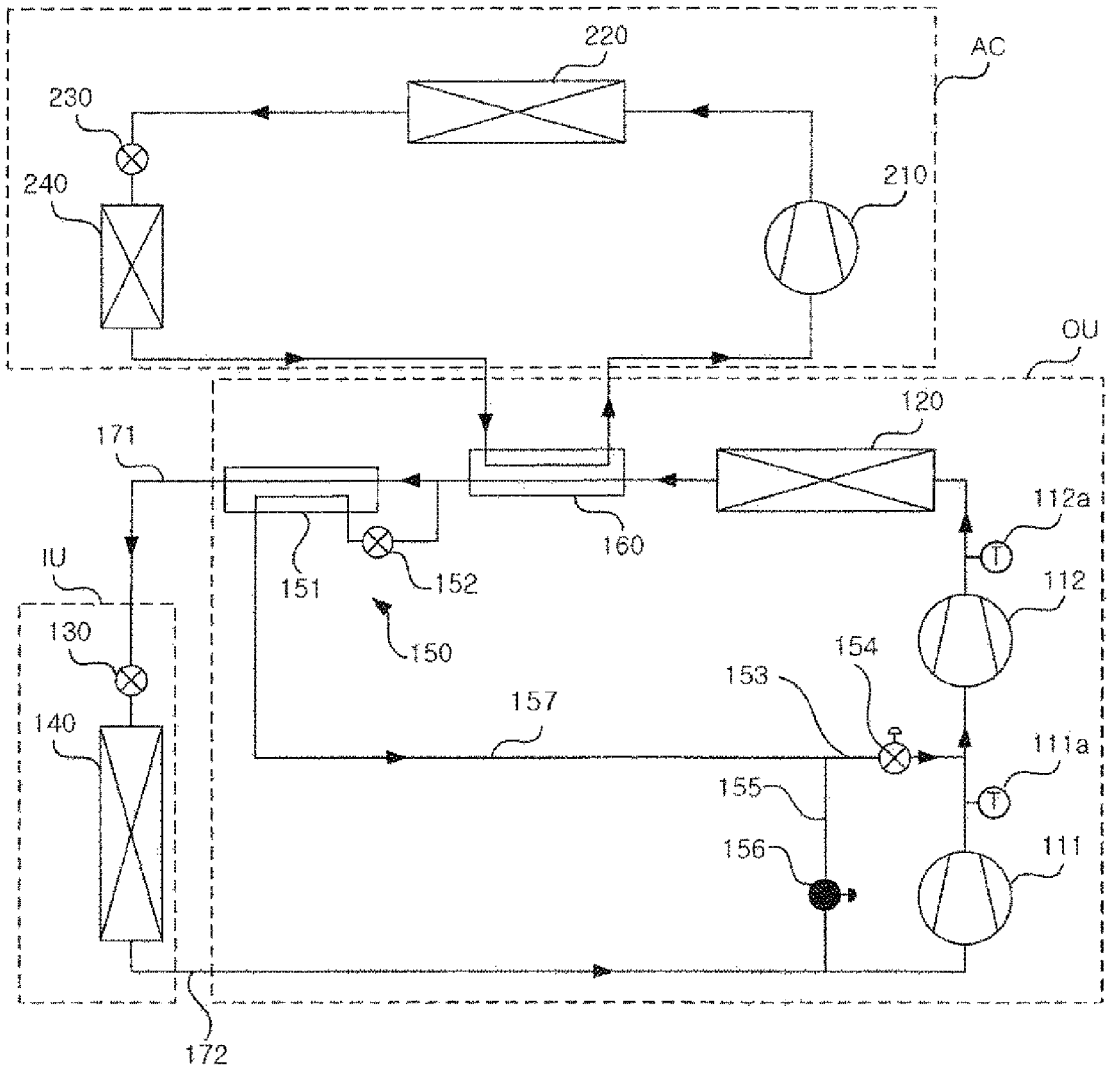
FIG. 6 is a view showing flow of refrigerant when opening an injection valve in an outdoor unit according to an embodiment.
Figure 7:
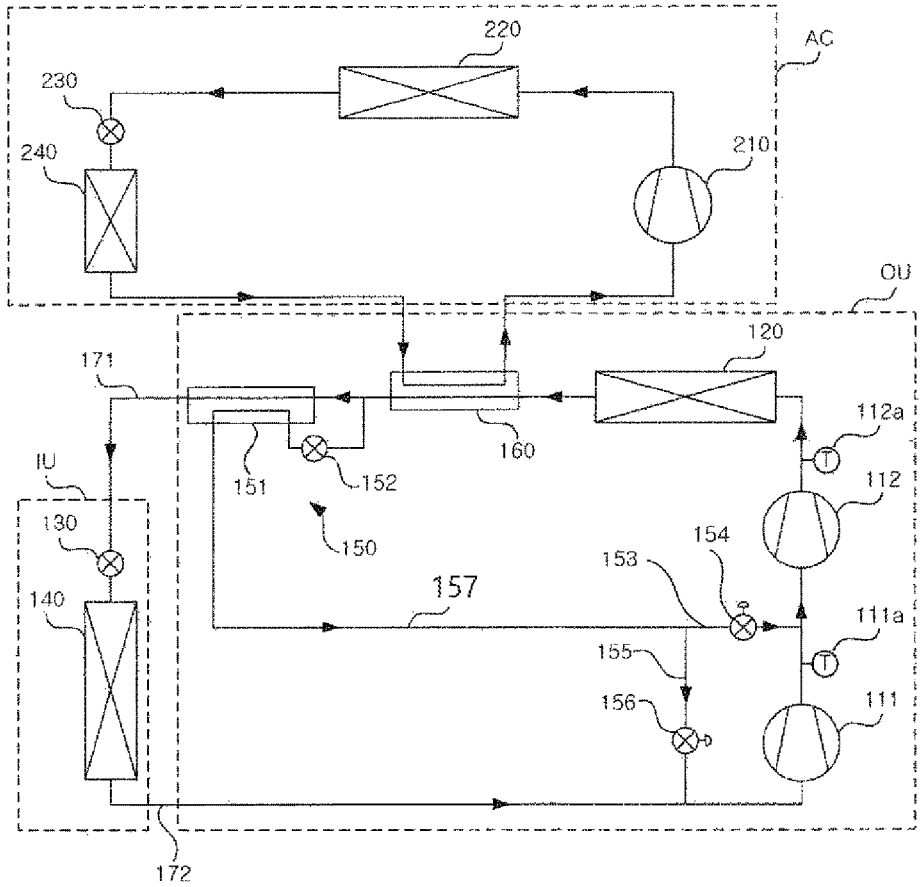
FIG. 7 is a view showing flow of refrigerant when opening a bypass valve and an injection valve in an outdoor unit according to an embodiment.

FIG. 3 is a flowchart illustrating a control method of an outdoor unit according to an embodiment of the present invention, FIG. 4 is a view showing flow of refrigerant in non-operation of a supercooler in an outdoor unit according to an embodiment of the present invention, FIG. 5 is a view showing flow of refrigerant when opening a bypass valve in an outdoor unit according to an embodiment, FIG. 6 is a view showing flow of refrigerant when opening an injection valve in an outdoor unit according to an embodiment, and FIG. 7 is a view showing flow of refrigerant when opening a bypass valve and an injection valve in an outdoor unit according to an embodiment.

The embodiment disclosed in FIG. 3 is a control method of the outdoor unit performed in a state where the low pressure side discharge temperature T_o1 and the high pressure side discharge temperature T_o2 are normal. The supercooling expansion valve 152, the bypass valve 156, and the injection valve 154 of the supercooler 150 are closed in the state where the low pressure side discharge temperature T_o1 and the high pressure side discharge temperature T_o2 are normal.

Hereinafter, the flow of the refrigerant in the state where the low pressure side discharge temperature T_o1 and the high pressure side discharge temperature T_o2 are normal will be described with reference to FIG. 4.

First, the flow of the refrigerant of the air conditioner AC will be described. The refrigerant compressed in the air conditioning compressor 210 is condensed in the air conditioning condenser 220. The refrigerant condensed in the air conditioning condenser 220 is expanded in the air conditioning expansion valve 230 and then evaporated in the air conditioning evaporator 240 to cool the room. The refrigerant evaporated in the air conditioning evaporator 240 is heat-exchanged in the heat recovery unit 160 and then compressed in the air conditioning compressor 210.

Meanwhile, the refrigerant compressed by the low pressure side compressor 111 is recompressed by the high pressure side compressor 112. The refrigerant compressed by the high pressure side compressor 112 is condensed in the outdoor heat exchanger. The refrigerant condensed in the outdoor heat exchanger 120 is cooled by heat exchange with the refrigerant evaporated in the air conditioner AC in the heat recovery unit 160. Since the supercooling expansion valve 152 of the supercooler 150 is closed in the state where the low pressure side discharge temperature T_o1 and the high pressure side discharge temperature T_o2 are normal, the refrigerant cooled in the heat recovery unit 160 passes through the supercooler 150. The refrigerant passed through the supercooler 150 flows to the refrigerator (IU) through the liquid pipe 171.

The refrigerant introduced into the refrigerator (IU) is expanded in the refrigeration expansion valve 130 and then evaporated in the refrigeration heat exchanger 140 to refrigerate or freeze the storage stored in the refrigerator (IU). The refrigerant evaporated in the refrigeration heat exchanger 140 flows to the outdoor unit (OU) through the gas pipe 172. The refrigerant introduced into the outdoor unit (OU) is compressed by the low pressure side compressor 111.

Even if the supercooler 150 does not cool the refrigerant in the above-described process, the heat recovery unit 160 cools the refrigerant, so that supercooling is ensured. In addition, since there is no refrigerant flowing into the low pressure side compressor 111 or the high pressure side compressor 112 through the supercooler 150, a sufficient amount of refrigerant may be introduced into the refrigerator (IU).

The control method of the outdoor unit according to an embodiment of the present invention will be described with reference to FIG. 3.

The controller 10 determines whether the low pressure side discharge temperature T_o1 measured by the low pressure side discharge temperature sensor 111*a* is equal to or higher than a set low pressure side reference temperature T1 or whether the high pressure side discharge temperature T_o2 measured by the high pressure side discharge temperature sensor 112*a* is equal to or higher than a set high pressure side reference temperature T2 (S310).

When the temperature T_o1 of the refrigerant discharged from the low pressure side compressor 111 measured by the low pressure side discharge temperature sensor 111*a* or the temperature T_o2 of the refrigerant discharged from the high pressure side compressor 112 measured by the high pressure side discharge temperature sensor 112*a* is too high, the system efficiency may be lowered and the refrigeration performance may be deteriorated. Therefore, the controller 10 determines whether the low pressure side discharge temperature T_o1 or the high pressure side discharge temperature T_o2 is abnormally high.

When the low pressure side discharge temperature T_o1 measured by the low pressure side discharge temperature sensor 111*a* is equal to or higher than the set low pressure side reference temperature T1, or when the high pressure side discharge temperature T_o2 measured by the high pressure side discharge temperature sensor 112*a* is equal to or higher than the set high pressure side reference temperature T2, the controller 10 opens the supercooling expansion valve 152 (S320). When determining that the low pressure side discharge temperature T_o1 or the high pressure side discharge temperature T_o2 is abnormally high, the controller 10 opens the supercooling expansion valve 152 of the supercooler 150 to adjust the opening degree so that the supercooler 150 can cool the refrigerant.

When the low pressure side discharge temperature T_o1 is equal to or higher than the set low pressure side reference temperature T1 but the high pressure side discharge temperature T_o2 is lower than the set high pressure side reference temperature T2 (S330), the controller 10 opens the bypass valve 156 (S340). When the controller 10 determines that only the low pressure side discharge temperature T_o1 is abnormally high and the high pressure side discharge temperature T_o2 is normal, the controller 10 opens the bypass valve 156 of the supercooler 150, so that the refrigerant which is expanded in the supercooling expansion valve 152 and evaporated in the supercooling heat exchanger 151 flows to the low pressure side compressor 111.

The flow of refrigerant different from FIG. 4 will be described with reference to FIG. 5 in a state where the low pressure side discharge temperature T_o1 is abnormal and the high pressure side discharge temperature T_o2 is normal.

When the supercooling expansion valve 152 is opened to adjust the opening degree, a part of the refrigerant cooled in the heat recovery unit 160 is expanded in the supercooling expansion valve 152 and then evaporated in the supercooling heat exchanger 151. Another part of the refrigerant cooled in the heat recovery unit 160 is cooled in the supercooling heat exchanger 151. The refrigerant cooled in the supercooler 150 flows to the refrigerator (IU) through the liquid pipe 171.

The refrigerant evaporated in the supercooling heat exchanger 151 flows to the supercooling pipe 157. Since only the bypass valve 156 is opened, the refrigerant introduced into the supercooling pipe 157 flows into the low pressure side compressor 111 through the bypass pipe 155 and then is compressed.

Since the refrigerant which is evaporated after being expanded in the supercooler 150 flows into the low pressure side compressor 111, the low pressure side discharge temperature T_o1 may be reduced.

When the high pressure side discharge temperature T_o2 is equal to or higher than the set high pressure side reference temperature T2 or when the low pressure side discharge temperature T_o1 is lower than the set high pressure side reference temperature T1 (S350), the controller 10 opens the injection valve 154 (S360). When determining that only the high pressure side discharge temperature T_o2 is abnormally high and the low pressure side discharge temperature T_o1 is normal, the controller 10 opens the injection valve 154 of the supercooler 150 so that the refrigerant which is expanded in the supercooling expansion valve 152 and is evaporated in the supercooling heat exchanger 151 can flow to the high pressure side compressor 112.

The flow of refrigerant different from FIG. 4 will be described with reference to FIG. 6 in a state where the high pressure side discharge temperature T_o2 is abnormal and the low pressure side discharge temperature T_o1 is normal.

When the supercooling expansion valve 152 is opened and the opening degree is adjusted, a part of the refrigerant cooled in the heat recovery unit 160 is expanded in the supercooling expansion valve 152 and then is evaporated in the supercooling heat exchanger 151. Another part of the refrigerant cooled in the heat recovery unit 160 is cooled in the supercooling heat exchanger 151. The refrigerant cooled in the supercooler 150 flows to the refrigerator (IU) through the liquid pipe 171.

The refrigerant evaporated in the supercooling heat exchanger 151 flows to the supercooling pipe 157. Since only the injection valve 154 is opened, the refrigerant introduced into the supercooling pipe 157 flows into the high pressure side compressor 112 through the injection pipe 153 and is compressed.

Since the refrigerant which is evaporated after being expanded in the supercooler 150 is introduced into the high pressure side compressor 112, the high pressure side discharge temperature T_o2 may be reduced.

When the low pressure side discharge temperature T_o1 is equal to or higher than the set low pressure side reference temperature T1 and the high pressure side discharge temperature T_o2 is also equal to or higher than the set high pressure side reference temperature T2, the controller 10 opens the bypass valve 156 and the injection valve 154 (S370). When determining that both the low pressure side discharge temperature T_o1 and the high pressure side discharge temperature T_o2 are abnormally high, the controller 10 opens the bypass valve 156 and the injection valve 154 of the supercooler 150 so that the refrigerant which is expanded in the supercooling expansion valve 152 and evaporated in the supercooling heat exchanger 151 flows to the low pressure side compressor 111 and the high pressure side compressor 112.

The flow of refrigerant different from FIG. 4 will be described with reference to FIG. 7 in a state where the low pressure side discharge temperature T_o1 and the high pressure side discharge temperature T_o2 are abnormal.

When the supercooling expansion valve 152 is opened and the opening degree is adjusted, a part of the refrigerant cooled in the heat recovery unit 160 is expanded in the supercooling expansion valve 152 and then is evaporated in the supercooling heat exchanger 151. Another part of the refrigerant cooled in the heat recovery unit 160 is cooled in the supercooling heat exchanger 151. The refrigerant cooled in the supercooler 150 flows to the refrigerator (IU) through the liquid pipe 171.

The refrigerant evaporated in the supercooling heat exchanger 151 flows to the supercooling pipe 157. Since both the bypass valve 156 and the injection valve 154 are opened, a part of the refrigerant introduced into the supercooling pipe 157 is introduced into the low pressure side compressor 111 through the bypass pipe 155 and compressed, and another part flows into the high pressure side compressor 112 through the injection pipe 153 and is compressed.

Since the refrigerant which is evaporated after being expanded in the supercooler 150 flows into the low pressure side compressor 111 and the high pressure side compressor 112, both the low pressure side discharge temperature T_o1 and the high pressure side discharge temperature T_o2 can be reduced.

Even if the amount of refrigerant flowing into the refrigerator (IU) is reduced, it is necessary to reduce both the low pressure side discharge temperature T_o1 and the high pressure side discharge temperature T_o2. Therefore, when both the low pressure side discharge temperature T_o1 and the high pressure side discharge temperature T_o2 are abnormal, it is preferable that the controller 10 increases the opening degree of the supercooling expansion valve 152 than when only the low pressure side discharge temperature T_o1 or the high pressure side discharge temperature T_o2 is abnormal.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

INDUSTRIAL APPLICABILITY

The present invention can be utilized in various outdoor units that compress and condense refrigerant for various purposes such as refrigeration, freezing, cooling, and the like.

The invention claimed is:

1. An outdoor unit connected to a refrigerator for refrigerating storage and an air conditioner for cooling a room, the outdoor unit comprising:

a low pressure side compressor for compressing a refrigerant;

a high pressure side compressor for compressing the refrigerant compressed by the low pressure side compressor;

an outdoor heat exchanger for condensing the refrigerant compressed by the high pressure side compressor;

a heat recovery exchanger for cooling the refrigerant condensed in the outdoor heat exchanger by exchanging heat with the refrigerant evaporated in the air conditioner; and a supercooler for expanding a part of the refrigerant cooled in the heat recovery exchanger to cool another part of the refrigerant cooled in the heat recovery exchanger, wherein the supercooler comprises:

a supercooling expansion valve for expanding a part of the refrigerant cooled in the heat recovery exchanger;

a supercooling heat exchanger for cooling another part of the refrigerant cooled in the heat recovery exchanger by exchanging heat with the refrigerant expanded in the supercooling expansion valve;

a bypass valve for guiding the refrigerant which is expanded in the supercooling expansion valve and evaporated in the supercooling heat exchanger to a suction side of the low pressure side compressor when the bypass valve is opened; and an injection valve for guiding the refrigerant which is expanded in the supercooling expansion valve and evaporated in the supercooling heat exchanger to a suction side of the high pressure side compressor when the injection valve is opened, further comprising:

a low pressure side discharge temperature sensor for measuring a low pressure side discharge temperature which is a temperature of the refrigerant discharged from the low pressure side compressor;

a high pressure side discharge temperature sensor for measuring a high pressure side discharge temperature which is a temperature of the refrigerant discharged from the high pressure side compressor; and a controller configured to control the supercooling expansion valve, the bypass valve, and the injection valve according to the low pressure side discharge temperature measured by the low pressure side discharge temperature sensor and/or the high pressure side discharge temperature measured by the high pressure side discharge temperature sensor, wherein the controller is configured to control the bypass valve to be opened according to the low pressure side discharge temperature measured by the low pressure side discharge temperature sensor, and to control the injection valve to be opened according to the high pressure side discharge temperature measured by the high pressure side discharge temperature sensor, wherein the controller is configured to control the supercooling expansion valve to be opened and closed according to the low pressure side discharge temperature measured by the low pressure side discharge temperature sensor and the high pressure side discharge temperature measured by the high pressure side discharge temperature sensor.

2. The outdoor unit of claim 1, wherein the controller is configured to control the supercooling expansion valve to have a first opening degree when both the bypass valve and the injection valve are opened and to control the supercooling expansion valve to have a second opening degree, less than the first opening degree, when a first one of the bypass valve and the injection valve is opened and a second one of the bypass valve and the injection value is not opened, the second one being different than the first one.

3. A method of controlling an outdoor unit which is connected to a refrigerator for refrigerating storage and an air conditioner for cooling a room, and the outdoor unit comprises a low pressure side compressor, a high pressure side compressor, an outdoor heat exchanger, a heat recovery exchanger for cooling the refrigerant condensed in the outdoor heat exchanger by exchanging heat with the refrigerant evaporated in the air conditioner, and a supercooler for expanding a part of the refrigerant cooled in the heat recovery exchanger to cool another part of the refrigerant cooled in the heat recovery exchanger, the method comprising:

a discharge temperature measuring step of measuring a low pressure side discharge temperature which is a temperature of a refrigerant discharged from the low pressure side compressor, and a high pressure side discharge temperature which is a temperature of a refrigerant discharged from the high pressure side compressor; and a supercooling step of guiding the refrigerant expanded in the supercooler to a suction side of the low pressure side compressor or a suction side of the high pressure side compressor according to the low pressure side discharge temperature or the high pressure side discharge temperature, wherein the supercooler comprises:

a supercooling expansion valve for expanding a part of the refrigerant cooled in the heat recovery exchanger;

a supercooling heat exchanger for cooling another part of the refrigerant cooled in the heat recovery exchanger by exchanging heat with the refrigerant expanded in the supercooling expansion valve;

a bypass valve for guiding the refrigerant which is expanded in the supercooling expansion valve and evaporated in the supercooling heat exchanger to a suction side of the low pressure side compressor when the bypass valve is opened; and an injection valve for guiding the refrigerant which is expanded in the supercooling expansion valve and evaporated in the supercooling heat exchanger to a suction side of the high pressure side compressor when the injection valve is opened, wherein the supercooling step comprises:

opening the supercooling expansion valve according to the low pressure side discharge temperature and the high pressure side discharge temperature;

opening the bypass valve according to the low pressure side discharge temperature; and opening the injection valve according to the high pressure side discharge temperature.

* * * * *